US010656572B2

(12) United States Patent
Kataoka

(10) Patent No.: US 10,656,572 B2
(45) Date of Patent: May 19, 2020

(54) FIXING DEVICE AND IMAGE FORMING DEVICE

(71) Applicant: Konica Minolta, Inc., Chiyoda-ku, Tokyo (JP)

(72) Inventor: Naoki Kataoka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/285,368

(22) Filed: Feb. 26, 2019

(65) Prior Publication Data

US 2019/0265617 A1 Aug. 29, 2019

(30) Foreign Application Priority Data

Feb. 28, 2018 (JP) ..... 2018-034967

(51) Int. Cl.
*G03G 15/20* (2006.01)

(52) U.S. Cl.
CPC . *G03G 15/2025* (2013.01); *G03G 2215/2025* (2013.01); *G03G 2215/2038* (2013.01)

(58) Field of Classification Search
CPC ..... G03G 15/2025; G03G 2215/2025
See application file for complete search history.

(56) References Cited

U.S. PATENT DOCUMENTS

2011/0158716 A1* 6/2011 Fujiwara ..... G03G 15/2053 399/329
2017/0364006 A1* 12/2017 Minemura ..... G03G 15/2053
2018/0011435 A1* 1/2018 Tsubotani ..... G03G 15/2028

FOREIGN PATENT DOCUMENTS

JP 2004184446 A 7/2004
JP 2008046663 A 2/2008

* cited by examiner

*Primary Examiner* — Sandra Brase
(74) *Attorney, Agent, or Firm* — Cantor Colburn LLP

(57) ABSTRACT

A fixing device including a heated endless belt, a first member, a second member, a pressure roller, a guide member, a sliding member, and a lubricant application member. The first member is a non-rotating body inside of the belt and together with the second member tensions the belt. The pressure roller is outside the belt and presses against the first member via the belt, thereby forming the fixing nip. The guide member is inside of the belt and has a guide surface that guides the belt in circulation and a recess opening into the guide surface. The sliding member is between the belt and the first member. The lubricant application member is fitted in the recess and applies lubricant to the belt. The guide surface has an arc shape that is interrupted by the recess in a cross section perpendicular to an axis of rotation of the pressure roller.

11 Claims, 5 Drawing Sheets

FIXING DEVICE AND IMAGE FORMING DEVICE

CROSS REFERENCE TO RELATED APPLICATION

The present application claims priority under 35 U.S.C. § 119 to Japanese Patent Application No. 2018-034967 filed Feb. 28, 2018, the contents of which are hereby incorporated herein by reference in their entirety.

BACKGROUND

Technical Field

The present disclosure relates to fixing devices and image forming devices that fix unfixed images on sheets.

Description of the Related Art

Among image forming devices such as printers are devices that include a fixing device that uses an endless belt (for example, JP 2008-046663, JP 2004-184446).

FIG. 6 is a cross-section diagram schematically illustrating an example of a fixing device. As illustrated, a fixing device 90 includes a belt 91 that is endless, a pressure member 92 that has a U-shaped cross-section disposed inside the belt 91, a support member 93 that supports the pressure member 92, a heating roller 94 that tensions the belt 91, a heater 95 that heats the heating roller 94, and a pressure roller 96 disposed outside the belt 91 that presses the belt 91 against the pressure member 92 and forms a fixing nip 9 between the pressure roller 96 and the belt 91. The belt 91 follows rotation of the pressure roller 96 that rotates in a direction indicated by arrow A, travelling in a direction indicated by arrow B.

In such a configuration, when a sheet S conveyed along a conveyance path 99 in a direction indicated by an arrow D passes through the fixing nip 9, heat from the heated belt 91 and pressure from the pressure roller 96 cause an unfixed image on the sheet S to be fixed.

SUMMARY

In the structure described above, a wrapping length Lb in a circumferential direction of the belt 91 with respect to the pressure member 92 supported by the support member 93 is long. As a result, sliding resistance due to direct contact between the pressure member 92 and the belt 91, from one end to another end in the direction of belt travel, is large, which makes it easier for travel speed of the belt 91 to become unstable. When travel speed of the belt 91 becomes unstable, a difference in speed occurs with a sheet S conveyed to the fixing nip 9 at a constant speed, leading to a decrease in fixing performance.

The present disclosure aims to provide a fixing device and an image forming device that can improve belt travel stability.

To achieve at least one of the abovementioned objects, according to an aspect of the present disclosure, a fixing device reflecting one aspect of the present disclosure is a fixing device for fixing an unfixed image on a sheet by passing the sheet through a fixing nip, the fixing device comprising: a heated endless belt; a first member that is a non-rotating body disposed inside of the belt; a second member disposed inside of the belt, cooperating with the first member to tension the belt; a pressure roller disposed outside of the belt that presses against the first member via the belt, thereby forming the fixing nip between the pressure roller and the belt; a guide member disposed inside of the belt that has a guide surface and guides the belt via the guide surface being in surface contact with an inner circumferential surface of the belt in circulation; a sliding member disposed between the belt and the first member; and a lubricant application member that applies lubricant to the inner circumferential surface of the belt, wherein the guide member has a recess opening into the guide surface, the guide surface has an arc shape that is interrupted by the recess in a cross section taken on a virtual plane perpendicular to an axis of rotation of the pressure roller, and the lubricant application member is fitted in the recess.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the invention. In the drawings.

DETAILED DESCRIPTION

Hereinafter, a fixing device and an image forming device pertaining to embodiments of the present disclosure are described with reference to the drawings, using a tandem-type color printer (also referred to as "printer") as an example.

(1) Printer Overall Configuration

Figure 1:
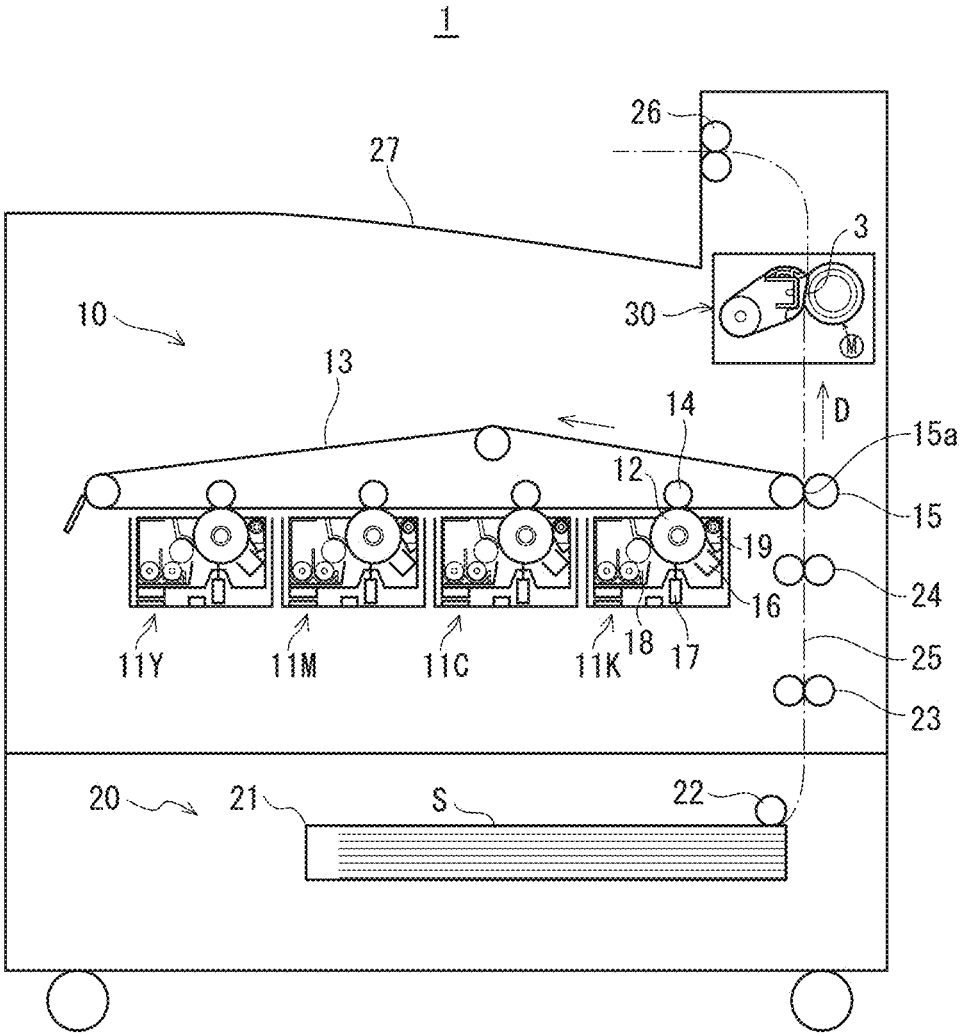
FIG. 1 is a schematic diagram illustrating an overall configuration of a printer.

FIG. 1 is a schematic cross-section diagram illustrating an overall configuration of a printer 1.

In FIG. 1, the printer 1 includes an image forming unit 10, a paper feeder 20, and a fixing unit 30.

The image forming unit 10 includes imaging units 11Y, 11M, 11C, 11K corresponding to colors yellow (Y), magenta (M), cyan (C), and black (K), and an intermediate transfer belt 13.

The imaging unit 11K includes a photosensitive drum 12, and arranged around the photosensitive drum in a circumferential direction, a charging unit 16, an exposure unit 17, a developer unit 18, and a cleaner 19.

The exposure unit 17 includes a light emitting element such as a laser diode, a lens, and the like, and, according to a drive signal from a controller (not illustrated), modulates laser light to expose and scan the photosensitive drum 12.

The photosensitive drum 12 is driven to rotate by a drive source (not illustrated), and prior to exposure, residual toner is removed from a surface of the photosensitive drum 12 by the cleaner 19 and the surface is uniformly charged by the charging unit 16. When the uniformly charged surface is exposed to the laser light, an electrostatic latent image is formed on the surface of the photosensitive drum 12.

The electrostatic latent image formed on the photosensitive drum 12 is developed by the developer unit 18, thereby forming a K color toner image on the surface of the photosensitive drum 12. The K color toner image is transferred from the photosensitive drum 12 onto the intermediate transfer belt 13 by a primary transfer roller 14 disposed on an opposite side of the intermediate transfer belt 13 to the photosensitive drum 12.

The imaging units 11Y, 11M, 11C have the same structure as the imaging unit 11K, and corresponding elements have the same reference signs. In each imaging unit, a toner image of a corresponding color (Y, M, C) is developed on the photosensitive drum 12, and the toner image is transferred onto the intermediate transfer belt 13 by the primary transfer roller 14.

Imaging operations in the imaging units 11Y, 11M, 11C, 11K are executed at staggered timings so that the toner images are transferred onto the same overlapping position on the intermediate transfer belt 13. Thus, a Y, M, C, K color toner image is formed on the intermediate transfer belt 13.

The paper feeder 20 includes a paper cassette 21 that stores sheets S, a feeding roller 22, a transport roller 23, and a timing roller 24.

The feeding roller 22 contacts a topmost one of the sheets S of the paper cassette 21, and feeds it to a conveyance path 25. The sheet S fed by the feeding roller 22 is conveyed by the conveyance roller 23 to the timing roller 24. The timing roller 24 sends the sheet S downstream at a timing instructed by a controller (not illustrated).

In the image forming unit 10, the color toner image transferred onto the intermediate transfer belt 13 is moved to a secondary transfer position 15*a*, which is a contact position where the intermediate transfer belt 13 and a secondary transfer roller 15 are in contact with each other, by the travel of intermediate transfer belt 13.

In coordination with timing of movement of the color toner image on the intermediate transfer belt 13, the sheet S is conveyed on the conveyance path 25 from the timing roller 24 of the paper feeder 20, and as the sheet S passes through the secondary transfer position 15*a*, the color toner image on the intermediate transfer belt 13 is transferred to the sheet S by the secondary transfer roller 15. The sheet S that has passed through the secondary transfer position 15*a* is sent to the fixing unit 30.

As the sheet S conveyed in a direction indicated by an arrow D (sheet conveyance direction) from the secondary transfer roller 15 passes through a fixing nip 3, the fixing unit 30 fixes the color toner image (unfixed image) on the sheet S to the sheet S through heat and pressure.

The sheet S that has passed through the fixing unit 30 is discharged outside by a discharge roller 26 to be stored on a discharge tray 27.

(2) Fixing Unit Configuration

Figure 2:
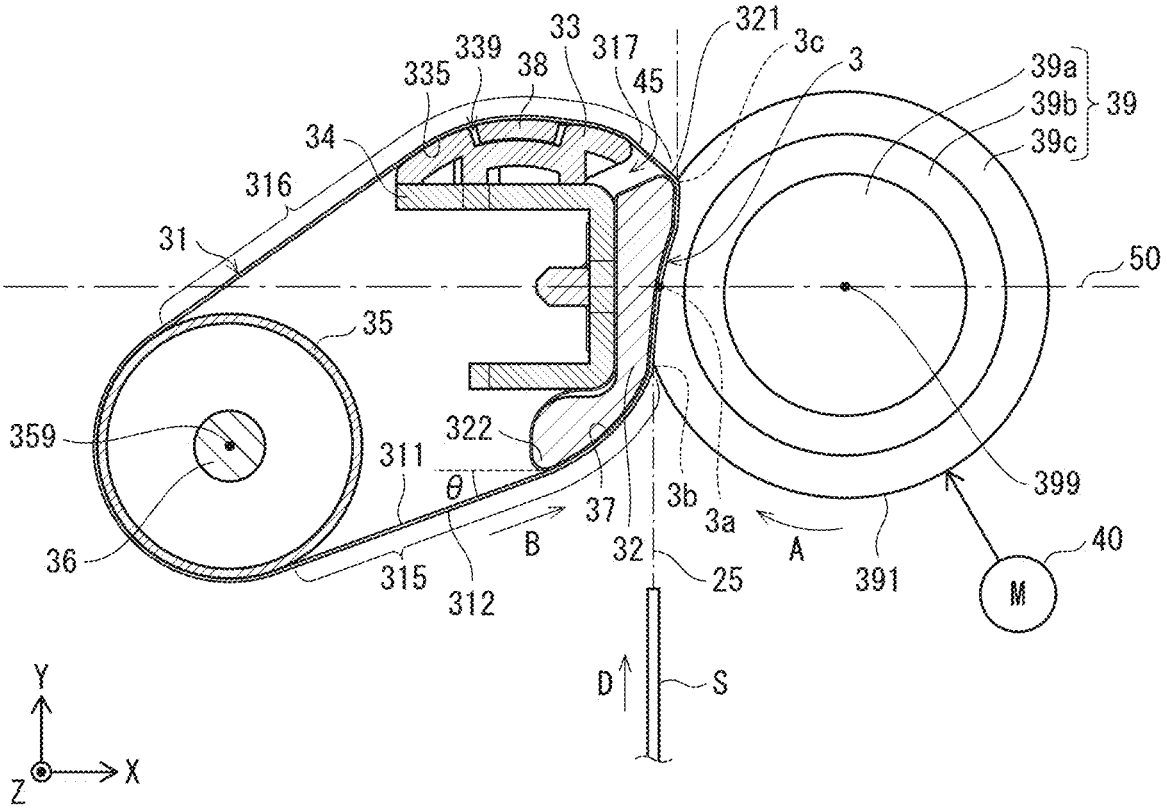
FIG. 2 is a cross-section diagram illustrating a schematic configuration of a fixing unit of a printer.

FIG. 2 is a schematic cross-section diagram illustrating configuration of the fixing unit 30. Here, in FIG. 2, the X axis direction and Y axis direction indicate a left-right direction and an up-down direction when viewing the printer 1 from the front, and the Z axis direction is perpendicular to both the X axis and the Y axis and corresponds to a depth direction of the printer 1. In FIG. 2, the fixing unit 30 is illustrated in a transverse cross-section taken on an X-Y plane perpendicular to the Z axis.

In FIG. 2, the fixing unit 30 includes a belt 31 that is endless, a pressure member 32 in contact with an inner circumferential surface 311 of the belt 31 via a sliding member 37, a guide member 33 in contact with the inner surface 311 of the belt 31 that guides the belt 31, a support member 34 that fixes and supports the pressure member 32 and the guide member 33, a heating roller 35 that heats the belt 31, a heater 36 that applies heat to the heating roller 35, a lubricant application member 38 that applies lubricant to the inner circumferential surface 311 of the belt 31, and a pressure roller 39 that presses against an outer circumferential surface 312 of the belt 31.

The belt 31 is wrapped around the pressure member 32 (first member), the heating roller 35 (second member), and the guide member 33. The heating roller 35 is pushed away from the pressure member 32 by an elastic member such as a spring (not illustrated), in order that tension of a constant magnitude is applied to the belt 31.

The belt 31 is formed by laminating, in this order, a base layer made of a material such as polyimide, or stainless steel, nickel (Ni) electroforming, or the like, an elastic layer made of a material having high heat resistance such as silicone rubber, fluorine rubber, or the like, and a release layer that imparts releasability such as a fluorine tube, a fluorine coating, or the like.

The pressure roller 39 formed by laminating onto a solid metal core 39*a* made of aluminum, iron, or the like, in this order, an elastic layer 39*b* made of a material having high heat resistance such as silicone rubber, fluorine rubber, or the like, and a release layer 39*c* that imparts releasability such as a fluorine tube, fluorine coating, or the like.

The pressure roller 39 has an axis 399 of rotation parallel to the Z axis, and both axial ends of the pressure roller 39 are supported to be freely rotatable by a fixed frame of a casing of the fixing unit 30 (not illustrated, hereinafter also referred to as "frame"), and an outer circumferential surface 391 of the pressure roller 39 is pressed against the belt 31 by a force from an elastic member such as a spring (not illustrated).

The pressure roller 39 is driven to rotate at a defined rotation speed in a direction indicated by the arrow A by a rotational drive force from a fixing conveyance motor 40. The belt 31 is driven by rotation of the pressure roller 39 to travel in a direction indicated by the arrow B (belt circumferential direction). Note that the metal core 39*a* is not limited to being solid, and may be a metal pipe or the like.

The pressure member 32 and the guide member 33 are arranged lined up along the belt circumferential direction, and each is a non-rotating body that does not rotate with motion of the belt 31 and has a Z axis direction length substantially equal to a Z axis direction length of the belt 31 (belt width).

The pressure member 32 is a pressure pad disposed opposite the pressure roller 39 disposed outside the belt 31, the pressure member 32 and the pressure roller 39 sandwiching the belt 31. Between the inner circumferential surface 311 of the belt 31 and the pressure member 32 is the sliding member 37. The pressure member 32 receives a pressing force from the pressure roller 39, via the sliding member 37. Thus, the outer circumferential surface 391 of the pressure roller 39 and the outer circumferential surface 312 of the belt 31 are pressed against each other, forming the fixing nip 3 between the belt 31 and the pressure roller 39.

The guide member 33 is located downstream in the belt circumferential direction of the pressure member 32 and upstream in the belt circumferential direction of the heating roller 35, and closer to the pressure member 32 than the heating roller 35. Here, there is a gap 45 between the guide member 33 and the pressure member 32. The guide member 33 guides a belt portion 317 of the belt 31 immediately after passing through the fixing nip 3 further downstream in the belt circumferential direction.

The guide member 33 is disposed apart from the fixing nip 3 in the belt circumferential direction and does not contribute to the formation of the fixing nip 3.

The guide member 33 is provided to form a smooth curved shape for the circulation path of the belt 31 wrapped around the pressure member 32, which is a non-rotating body, and the heating roller 35, which is a rotating body. If the guide member 33 were not provided, the belt 31 would be bent at an upper end 321 of the pressure member 32 to a path towards the heating roller 35, stress would be concentrated at this bent portion, and a large burden would be applied to the belt 31. The upper end 321 of the pressure member 32 corresponds strictly to a position where the belt 31 travelling in the circumferential direction parts from the sliding member 37 between the belt 31 and the pressure member 32.

Here, the pressure member 32 and the guide member 33 are made from the same material. For example, a resin such as polyphenylene sulfide, polyimide, liquid crystal polymer, or the like is used, advantageously having excellent heat resistance. Further, a metal such as aluminum or iron, a ceramic, or the like may be used, or a combination of such with a silicone rubber, a fluorine rubber, or the like may be used. Further, the pressure member 32 and the guide member 33 may be made using different materials from each other.

The support member 34 is a made of a metal such as aluminum, iron, stainless steel, or the like, has a U-shaped cross section, and fixes and supports the pressure member 32, the guide member 33, and the sliding member 37.

Figure 3:
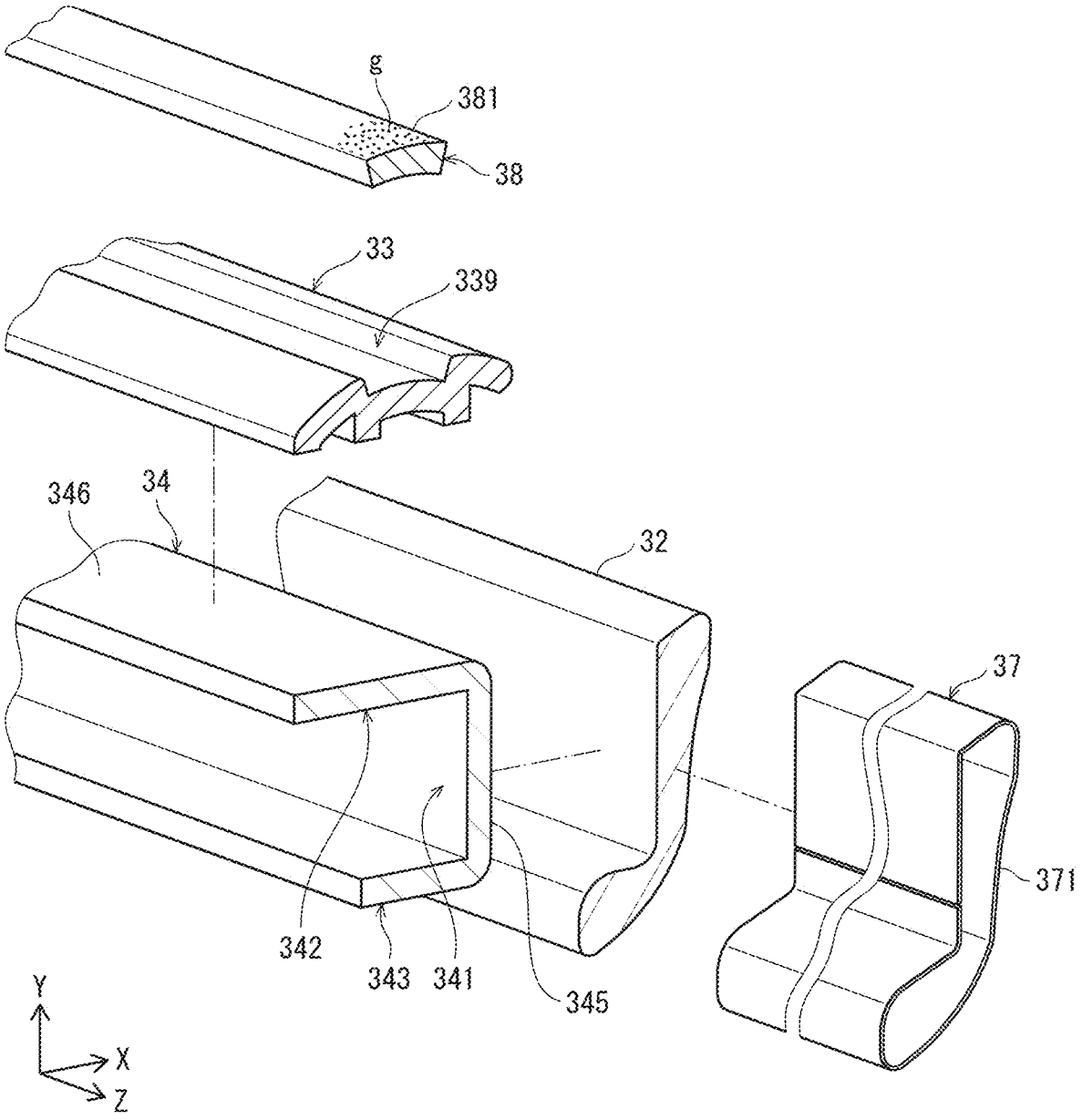
FIG. 3 is an exploded perspective view diagram of a support member, a pressure member, a guide member, a sliding member, and a lubricant application member.

FIG. 3 is a schematic exploded perspective view diagram of the support member 34, the pressure member 32, the guide member 33, the sliding member 37, and the lubricant application member 38. The belt 31 is not illustrated.

As illustrated in FIG. 3, the support member 34 is elongated in the Z axis direction, both longitudinal ends thereof being fixed to the frame, and the support member 34 includes a central portion 341 in the up-down direction, an upper horizontal portion 342 extending left from an upper end of the central portion 341, and a lower horizontal portion 343 extending left from a lower end of the central portion 341.

The pressure member 32 is fixedly supported by bonding or the like via the sliding member 37 to a right side surface 345 of the central portion 341 of the support member 34. The guide member 33 is fixedly supported by bonding or the like to an upper surface 346 of the upper horizontal portion 342 of the support member 34.

The lubricant application member 38 is elongated in the Z axis direction and has substantially the same length as the belt width of the belt 31. The lubricant application member 38 is embedded in a groove portion 339 of the guide member 33 that extends along the Z axis direction. The lubricant application member 38 includes a lubricant g, and an upper surface 381 of the lubricant member 38 is in direct contact with the inner circumferential surface 311 of the belt 31 and applies the lubricant g to the inner circumferential surface 311 of the belt 31.

The lubricant application member 38 is made of a material suitable for holding the lubricant g, for example a fibrous material such as aramid fiber, fluorine fiber, or the like, or a porous material such as a silicone sponge. Here, an elastically deformable material is used, but the lubricant application member 38 is not limited to this. As the lubricant g, a silicone-type or fluorine-type lubricant is used, but the lubricant g may be another material.

The sliding member 37 is a low friction sheet, and here is wrapped around the pressure member 32 so as to surround the circumference of the pressure member 32, and is, for example, a sheet of glass cloth having a sliding surface (outer surface) coated with a fluorine-type resin.

Small irregularities are formed on a belt-side surface 371 of the sliding member 37, reducing a contact surface area with the belt 31 in order to reduce frictional force. The sliding member 37 may be made of a material that can reduce sliding resistance with the belt 31, for example, a woven fabric of fluorine fiber, a fluorine resin sheet, or a glass coat.

The lubricant g applied to the inner circumferential surface 311 of the belt 31 by the lubricant application member 38 is interposed between the belt 31 and the pressure member 32 via the sliding member 37, and is supplied to the surface 371 of the sliding member 371 via the belt 31, thereby reducing sliding resistance with the belt 31, ensuring stability of travel of the belt 31 over a long period of time and reducing wear of the belt 31.

Returning to FIG. 2, the heating roller 35 is made of a cylinder made of a metal such as aluminum or stainless steel, an axis 359 of rotation of the heating roller 35 is parallel to the Z axis direction, and both axial ends of the heating roller 35 are supported by the frame to be rotatable.

It is advantageous that the diameter of the heating roller 35 is no more than 1.5 times a nip length of the fixing nip 3 (belt circumferential direction length). By making the diameter of the heating roller 35 small, it is possible to limit heat capacity, shorten warm-up time, and improve energy saving.

Further, the heating roller 35 is disposed such that $\alpha<\beta$, where $\alpha$ is a circumferential length of a belt portion 315 from the heating roller 35 to the fixing nip 3 and $\beta$ is a circumferential length of a belt portion 316 from the fixing nip 3 to the heating roller 35 via the guide member 33.

An amount of heat dissipation can be suppressed between the heating roller 35 and the fixing nip 3 by the amount the circumferential length a of the belt portion 315 is made short, meaning heat transmitted from the heating roller 35 to the belt 31 can be efficiently supplied to the fixing nip 3.

Further, in an imaginary plane (X-Y plane) perpendicular to the axis of rotation of the pressure roller 39, the pressure roller 39, the pressure member 32, the guide member 33, and the heating roller 35 are arranged relative to each other such that the axis 359 of rotation of the heating roller 35 is upstream in the sheet conveyance direction (direction indicated by arrow D) of an imaginary straight line 50 linking the axis 399 of rotation of the pressure roller 39 and a central portion **3*a* in the belt circumferential direction of the fixing nip 3**.

Thus, an entry angle $\theta$ of the belt portion 315 to a lower end 322 (farthest upstream end in the belt circumferential direction) of the pressure member 32 can be increased. The larger the entry angle $\theta$, the smaller the curvature of the belt portion 315 in contact with the lower end 322 of the pressure member 32, so that the curve becomes gradual and load on the belt 31 due to the curve becomes smaller.

The belt portion 315 is a portion that enters an inlet portion **3*b* (upstream end in the sheet conveyance direction) of the fixing nip 3, into which the belt 31 driven by rotation of the pressure roller 39 is pulled, and therefore the smaller the entry angle θ, the sharper the curve of the belt portion 315 in contact with the lower end 322 of the pressure member 32, the larger the pressure received from the lower end 322 from the pulling force, and the greater the load on the belt 31**.

When adopting a structure in which the entry angle θ is small, it may be necessary to provide an additional guide member similar to the guide member 33, but the present embodiment makes the entry angle θ as large as reasonably possible, thereby making it unnecessary to provide another guide member and thereby avoiding associated increases in size and cost. An outer surface of the heating roller 35 may be provided with a polytetrafluoroethylene (PTFE) coat in order to prevent scratches due to foreign matter or the like.

The heater 36 is a halogen heater elongated along an axial direction of the heating roller 35 inserted into an inner space of the heating roller 35. The heater 36 supplies heat generated from electrical power supplied from a power source (not illustrated) to the heating roller 35. In order that heat transmission from the halogen heater to the heating roller 35 is efficient, an inner circumferential surface of the heating roller 35 is advantageously black.

In this structure, when the pressure roller 39 is rotationally driven in the direction indicated by the arrow A, the rotational drive force is received by the belt 31, which is driven and travels in the direction indicated by the arrow B. When electrical current is passed through the heater 36 while the pressure roller 39 is rotationally driven, heat radiated from the heater 36 is transmitted from the heating roller 35 to the belt 31, and reaches the fixing nip 3 due to circumferential travel of the belt 31. Thus, heat from the heater 36 is supplied to the fixing nip 3.

According to the present embodiment, a sensor (not illustrated) is disposed in the fixing unit 30 for detecting a surface temperature of the belt 31 and sending a detection result to a controller (not illustrated). The controller performs a temperature adjustment control of switching on and off the heater 36 so that temperature of the fixing nip 3 is maintained at a fixing temperature required for fixing (for example 170° C.), based on detection results from the sensor.

According to this temperature adjustment control, the temperature of the fixing nip 3 is kept stable at the fixing temperature, and when the sheet S conveyed along the conveyance path 25 passes through the fixing nip 3, an unfixed image on the sheet S is heat-melted and pressurized to be fixed on the sheet S.

(3) Structure of Guide Member 33

Figure 4:
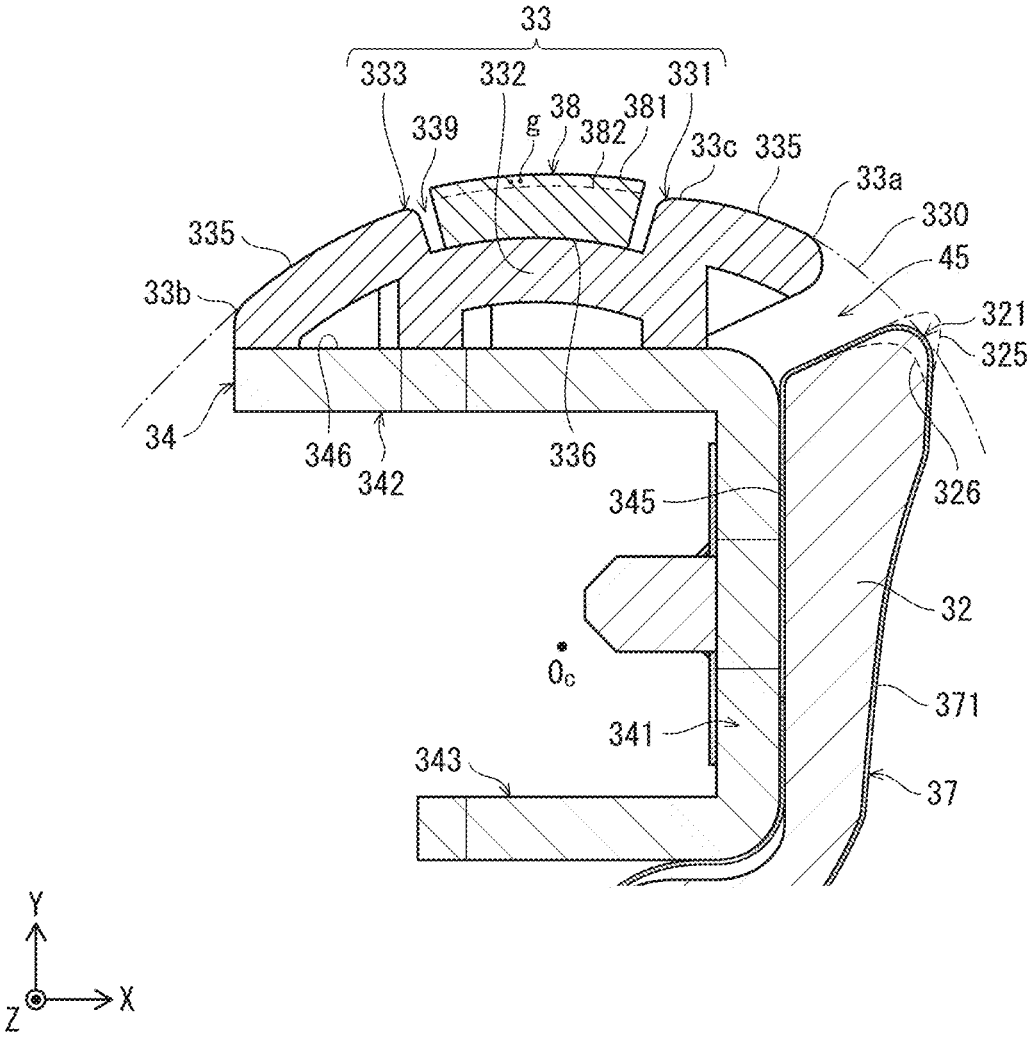
FIG. 4 is a cross-section diagram illustrating an enlargement of a guide member in a state without the belt illustrated in FIG. 2.

FIG. 4 is a cross section diagram of an enlargement of the guide member 33 illustrated without the belt 31 illustrated in FIG. 2, and illustrates upper ends of the pressure member 32 and the sliding member 37.

In FIG. 4, the guide member 33 is provided with the groove portion 339 at a central position in the belt circumferential direction of a guide surface 335 for guiding the belt 31. Here, the guide member 33 is described from upstream to downstream in the belt circumferential direction in terms of a first guide portion 331, a central portion 332, and a second guide portion 333.

The guide surface 335 has an arc shape in cross section in the X-Y plane, a center point of the arc being indicated by $0_c$ in FIG. 4. In FIG. 4, a dot-dash line 330 indicates a portion of a circumference of a circle centered on the center point $0_c$ and upper surfaces of the first guide portion 331 and the second guide portion 333 form the guide surface 335, which coincides with the dot-dash line 330.

An upper surface 336 of the central portion 332 between the first guide portion 331 and the second guide portion 333 is nearer the center point $0_c$ than the guide surface 335. Accordingly, a step is formed between the guide surface 335 and the upper surface 336, and the groove portion 339 is formed aligned along the Z axis and having a bottom surface that is the upper surface 336 of the central portion 332. Hereinafter, the bottom surface of the groove is referred as a bottom surface 336.

The lubricant application member 38, elongated in the Z axis direction and having a small thickness in the Y axis direction, is fitted into the groove 339 and fixed by adhesion or the like to the bottom surface 336 of the groove 339.

The lubricant application member 38 is an elastically deformable sponge or the like, as described above, and in a state in which the belt 31 is not present (in a natural state), the upper surface 381 of the lubricant application member 38 protrudes beyond the dot-dash line 330. That is, in a natural state, the upper surface 381 of the lubricant application member 38 has a greater height from the bottom surface 336 of the groove 339 than the guide surface 335 does.

When the belt 31 is wrapped around the pressure member 32, the guide member 33, and the heating roller 35, the inner circumferential surface 311 of the belt 31 is in surface contact with the guide surface 335 and the upper surface 381 of the lubricant application member 38 is pushed down in a thickness direction thereof by the belt 31 to be compressed down to the position indicated by a broken line 382, that is, the same height as the guide surface 335. The broken line 382 is a line that coincides with the dot-dash line 330. Thus, the upper surface 381 of the lubricant application member 38 is in close contact with the inner circumferential surface 311 of the belt 31 due to a restoring force of the lubricant application member 38 itself.

According to the present embodiment, the guide surface 335 describes an arc shape and the belt 31 forms a curve following the arc of the guide surface 335 in surface contact, and therefore contact pressure with the belt 31 tends to be substantially the same at any portion of the surface 335 from an upstream end 33*a* in the belt circumferential direction to a downstream end 33*b* via a more central portion 33*c*.

For example, if the guide surface 335 were a flat plane parallel to the X axis direction instead of an arc shape, the belt 31 would be more greatly curved at upstream (corresponding to 33*a*) and downstream (corresponding to 33*b*) ends of the flat plane guide surface, and therefore strong contact pressure from the belt 31 would be applied to the upstream and downstream ends.

On the other hand, at a portion (corresponding to 33*c*) of the flat plane guide surface closer to a center in the belt circumferential direction, the belt 31 would become substantially parallel to the flat plane guide surface, and therefore contact pressure would become considerably smaller. Where contact pressure is small, the lubricant application member 38 would lift the belt 31 by the restoring force, causing the belt 31 to lift away from the flat plane guide surface.

If the belt 31 were to lift away from the flat plane guide surface, there would be a risk of that portion of the belt 31 vibrating during circumferential travel and the vibration propagating from the belt 31 to the sheet S being conveyed through the fixing nip 3, and this could affect fixing.

According to the present embodiment, the belt 31 is in surface contact with the guide surface 335 in a shape following the arc of the guide surface 335, substantially equalizing contact pressure in the belt circumferential direction, so that sufficient contact pressure tends to act on even the portion 33*c* approaching the center even when the lubricant application member 38 is compressed. Thus, lifting of the belt 31 as described above is unlikely to occur, and it is possible to stabilize circumferential travel of the belt 31 and prevent adverse effects on fixing properties.

By bringing the upper surface 381 of the lubricant application member 38 into close contact with the belt 31, the lubricant g in the lubricant application member 38 is applied to the inner circumferential surface 311 of the belt 31 guided in the belt circumferential direction over the guide surface 335.

The lubricant g applied to the inner circumferential surface 311 of the belt 31 arrives at a contact area with the sliding member 37 via the heating roller 35 according to circumferential travel of the belt 31, and is supplied to the surface 371 of the sliding member 37 on the side of the belt 31. The lubricant g supplied to the sliding member 37 is held on the surface 371 of the sliding member 37, and therefore sliding resistance between the belt 31 and the pressure member 32 is reduced over a long period.

The guide surface 335 and the pressure member 32 upstream of the guide surface 335 in the belt circumferential direction are arranged relative to each other so that the upper end 321 of the pressure member 32 is positioned on an imaginary extension upstream in the belt circumferential direction of the circle described by the dot-dash line 330.

Thus, a path from a point where the belt 31 travelling in the circumferential direction leaves the upper end 321 of the pressure member 32 to the upper end 33*a* of the guide surface 335 of the guide member 33 coincides with a line extending from the arc of the guide surface 335 (corresponding to the dot-dash line 330), such that a cross section of the belt 31 on the path has the same arc shape as the guide surface 335.

Accordingly, when the belt 31 leaving the upper end 321 of the pressure member 32 arrives at the guide surface 335, the belt 31 is guided while maintaining the arc shape while in surface contact with the guide surface 335, and it becomes unlikely that a gap occurs between the belt 31 and the guide surface 335 as the belt proceeds along the guide surface 335.

By adopting a structure in which the upper end 321 of the pressure member 32 is positioned on the dot-dash line 330 as described above, the curvature of a portion of the belt 31 coming into contact with the upper end 321 of the pressure member 32 and the guide surface 335 becomes smaller and more gradual than in a structure in which the upper end 321 of the pressure member 32 is positioned on broken line 325 or broken line 326, for example. The stress applied to the portion of the belt 31 is smaller when the curvature is gradual than when the curvature is abrupt, and therefore the load on the belt 31 is reduced, which leads to a corresponding suppression of abrasion of the belt 31 and a longer life.

As described above, according to the present embodiment, the sliding member 37 is disposed between the belt 31 and the pressure member 32, and the inner circumferential surface 311 of the belt 31 travels in a state of surface contact with the arc-shaped guide surface 335 of the guide member 33 that is separated from the pressure member 32, while the lubricant g is applied to the inner circumferential surface 311 of the belt 31 from the lubricant application member 38 and is therefore supplied to the sliding member 37.

Thus, even when a strong pressing force acts between the pressure member 32 and the pressure roller 39, sliding resistance due to friction between the belt 31 and the pressure member 32 is reduced. Further, the belt 31 can travel in a state of surface contact with the guide surface 335, which has an arc shape, and vibration of the belt 31 due to lifting from the guide surface 335 can be prevented.

According to this combination of positioning of the sliding member 37, supply of the lubricant g, and the arc shape of the guide surface 335, travel stability of the belt 31 can be improved over prior art.

The guide member 33 having the guide surface 335 for guiding the belt 31 also serves as a member for supporting the lubricant application member 38 for applying the lubricant g to the belt 31. Accordingly, it is not necessary to provide a dedicated member for supporting the lubricant application member 38 that is separate from the guide member 33, and therefore cost reduction and device miniaturization can be accordingly achieved.

Further, the guide member 33 is disposed near an outlet portion 3*c* of the fixing nip 3 (sheet conveyance direction downstream end: FIG. 2), and therefore can guide the belt portion 317 immediately after heat applied from the heating roller 35 to the belt 31 is applied to the sheet S travelling through the fixing nip 3.

For example, if a structure were adopted in which the guide member 33 is disposed near the inlet portion 3*b* of the fixing nip 3, some heat would be lost from the belt 31 via the guide member 33 immediately prior to entering the fixing nip 3. According to the structure in which the guide member 33 is disposed near the outlet portion 3*c* of the fixing nip 3, such heat loss is avoided, heat applied to the belt 31 from the heating roller 35 is efficiently applied to the sheet S, and it becomes possible to use a lower heat capacity.

In a case in which the above-described heat loss does not affect fixing properties, a structure may be adopted in which the guide member 33 is disposed near the inlet portion 3*b* instead of the outlet portion 3*b* of the fixing nip 3.

Further, the pressure member 32 is not limited to the shape illustrated in FIG. 2 as long as it can form the fixing nip 3 suitable for the device structure, and similarly the guide member 33 is not limited to the shape illustrated in FIG. 2 as long as it can guide the belt 31 to travel stably.

Modifications

The present disclosure describes at least one embodiment, but the scope of the present disclosure is of course not limited to the embodiments described, and includes modifications such as described below.

(1) According to at least one embodiment, a structure is described in which only one of the guide member 33 is provided, but the present disclosure is not limited to this.

Figure 5:
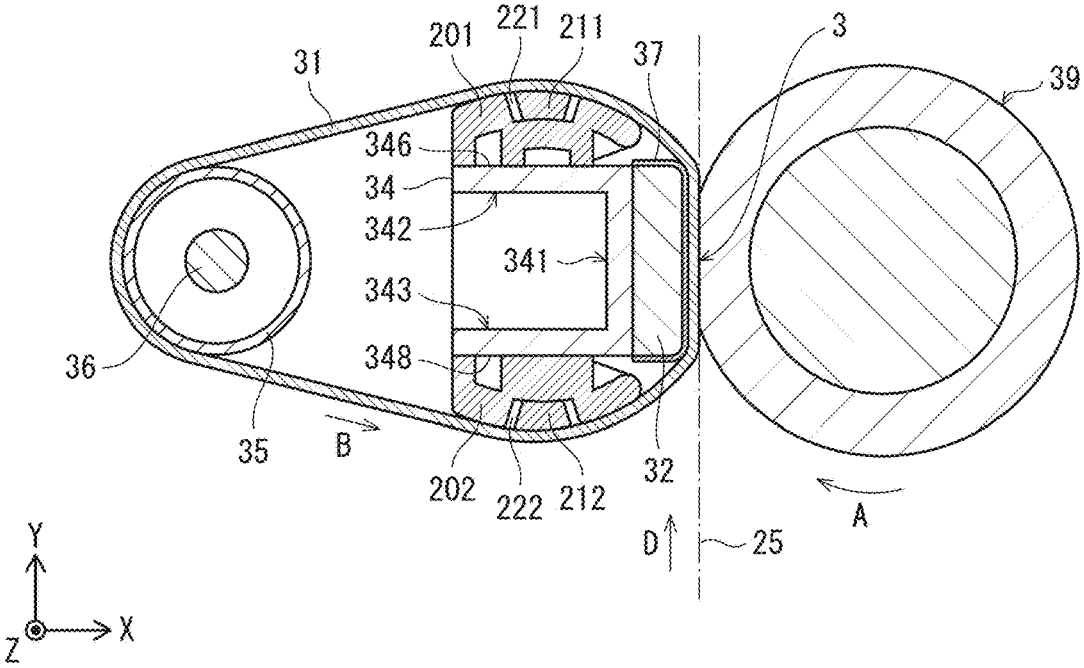
FIG. 5 is a cross-section diagram illustrating a configuration of a fixing unit pertaining to a modification.
Figure 6:
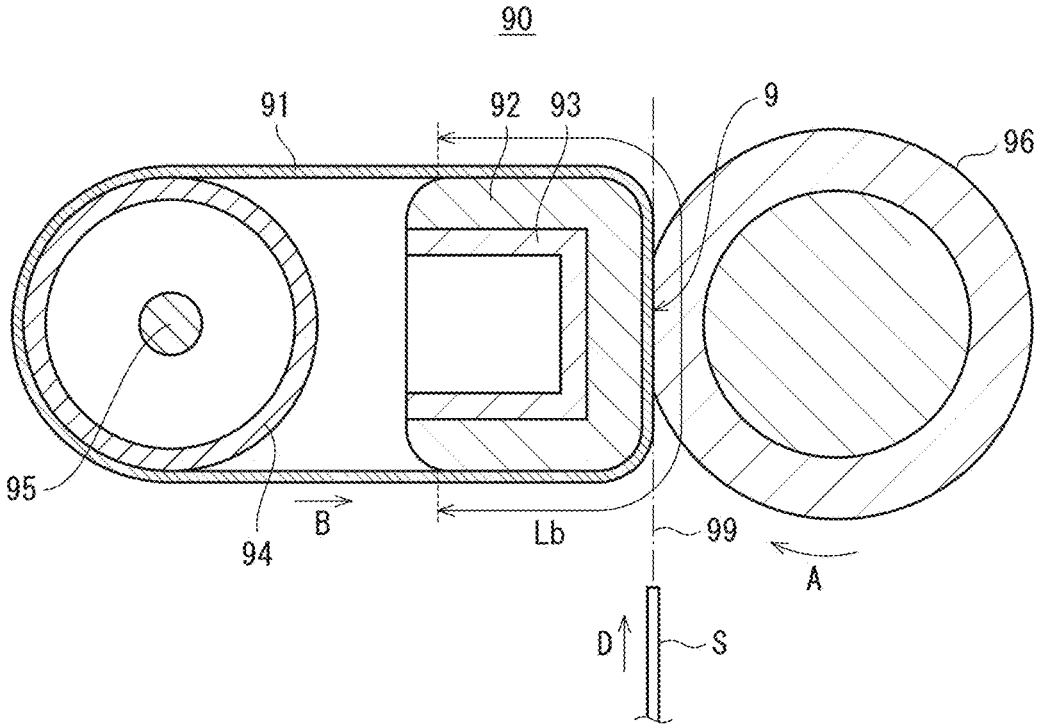
FIG. 6 is a cross-section diagram illustrating a schematic configuration of an example fixing device.

FIG. 5 is a cross section diagram illustrating a structure including two guide members.

As illustrated in FIG. 5, a first guide member 201 is fixed to the upper surface 346 of the upper horizontal portion 342 of the support member 34, and a second guide member 202 is fixed to a lower surface 348 of the lower horizontal portion 343 of the support member 34. Lubricant application members 211, 212 are fitted into and fixed to grooves 221, 222 provided in the guide members 201, 202. Further, a structure may be adopted in which the pressure member 32 is fixed directly to the central portion 341 of the support member 34, and the sliding member 37 is adhered or otherwise attached to the pressure member 32. Regarding the second guide member 202, a structure may be used in which the groove 222 and the lubricant application member 212 are not provided to the guide surface, and the guide surface is a continuous circular arc from an upstream end to a downstream end in the belt circumferential direction.

(2) According to at least one embodiment, a structure is described in which the groove 339 is provided to a central portion in the belt circumferential direction of the guide surface 335 of the guide member 33, but the groove 339 need not be provided to a central portion in the belt circumferential direction. The groove 339 may be positioned upstream or downstream of the central portion in the belt circumferential direction.

Further, a structure has been described in which the lubricant application member 38 is fitted into the groove 339, but the structure is not limited to a groove. It suffices that a recess in which the lubricant application member 38 can be fitted is provided to the guide surface 335, which has an arc shape. For example, a structure may be adopted in which, instead of a groove, a plurality of circular holes are aligned along the Z axis direction in the guide surface 335, and a lubricant application member is fitted into each hole.

(3) According to at least one embodiment, a structure has been described in which the belt 31 is wrapped around and driven by the pressure member 32 (first member), which is a non-rotating member, and the heating roller 35 (second member), which a rotating member, but the second member is not limited to being a rotating member. As long as the belt 31 can travel in the circumferential direction following the pressure roller 39, the second member may be a non-rotating member instead of a rotating member. For example, both ends of a cylindrical member can be fixed.

(4) According to at least one embodiment, the pressure member 32 is fixed by the support member 34, and the pressure roller 39 pushes against the pressure member 32 via the belt 31, but the present disclosure is not limited in this way. It suffices that the pressure member 32 is a non-rotating member that does not rotate following the direction of travel of the belt 31. For example, the pressure member 32 may press against the pressure roller 39 via the belt 31 according to a biasing force of a biasing member such as a spring. In any case, a pressing force acts between the pressure roller 39 and the pressing member 32.

(5) According to at least one embodiment, a structure is described that uses a halogen heater as the heater 36 that heats the belt 31, but the present disclosure is not limited to this example. Instead of a halogen heater, another type of heater can be used, such as an infrared heater or heating wire. Further, it suffices that there be a heat source that heats the belt 31. For example, the belt 31 may be a resistance heating element that generates heat via electric power supply. In this structure, electrical current to the resistance heating element becomes the heating of the belt 31. Further, the belt 31 may generate heat by electromagnetic induction, that is, an induction heating (IH) system may be used.

(6) According to at least one embodiment, an example is described in which the present disclosure is applied to an image forming device in a tandem-type color printer, but the present disclosure is not limited to this. The present disclosure can be applied to a fixing device that has an endless belt, and to image forming devices equipped with same. As image forming devices, the present disclosure can be applied to devices that can execute color image forming and to devices that can only execute monochrome image forming, and is not limited to printers, and can be applied to image forming devices such as copiers, facsimile devices, and multi-function peripherals (MFP).

Size, shape, material, number, and the like of each element described above are merely examples, and appropriate size, shape, material, number, and the like may be determined in accordance with device configuration.

Further, content of embodiments and modifications may be recombined in any possible combinations. Mechanisms and members of each element such as the fixing unit may be replaced by other mechanisms or members of different shapes as long as the effects of the present disclosure can be obtained.

Review

The embodiments and modifications described above illustrate at least one aspect of the present disclosure for resolving the technical problems described above, and the embodiments and modifications can be summarized as follows.

A fixing device reflecting one aspect of the present disclosure is a fixing device for fixing an unfixed image on a sheet by passing the sheet through a fixing nip, the fixing device comprising: a heated endless belt; a first member that is a non-rotating body disposed inside of the belt; a second member disposed inside of the belt, cooperating with the first member to tension the belt; a pressure roller disposed outside of the belt that presses against the first member via the belt, thereby forming the fixing nip between the pressure roller and the belt; a guide member disposed inside of the belt that has a guide surface and guides the belt via the guide surface being in surface contact with an inner circumferential surface of the belt in circulation; a sliding member disposed between the belt and the first member; and a lubricant application member that applies lubricant to the inner circumferential surface of the belt, wherein the guide member has a recess opening into the guide surface, the guide surface has an arc shape that is interrupted by the recess in a cross section taken on a virtual plane perpendicular to an axis of rotation of the pressure roller, and the lubricant application member is fitted in the recess.

According to this configuration, the sliding member is disposed between the belt and the first member, and the arc-shaped guide surface of the guide member, which is separate from the first member, guides the belt by being in surface contact with the inner circumferential surface of the belt while lubricant is applied to the inner circumferential surface of the belt, such that the lubricant is supplied to the sliding member through contact with the inner circumferential surface of the belt due to circumferential travel of the belt.

In this way, sliding resistance due to friction between the belt and the first member is reduced, and therefore travel stability of the belt can be improved over that of prior art.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A fixing device for fixing an unfixed image on a sheet by passing the sheet through a fixing nip, the fixing device comprising:

a heated endless belt;

a first member that is a non-rotating body disposed inside of the belt;

a second member disposed inside of the belt, cooperating with the first member to tension the belt;

a pressure roller disposed outside of the belt that presses against the first member via the belt, thereby forming the fixing nip between the pressure roller and the belt;

a guide member disposed inside of the belt that has a guide surface and guides the belt via the guide surface being in surface contact with an inner circumferential surface of the belt in circulation;

a sliding member disposed between the belt and the first member; and a lubricant application member that applies lubricant to the inner circumferential surface of the belt, wherein the guide member has a recess opening into the guide surface, the guide surface has an arc shape that is interrupted by the recess in a cross section taken on a virtual plane perpendicular to an axis of rotation of the pressure roller, and the lubricant application member is fitted in the recess.

2. The fixing device of claim 1, wherein the guide member is disposed downstream of the first member in a circumferential travel direction of the belt and upstream of the second member in the circumferential travel direction of the belt.

3. The fixing device of claim 2, wherein on the virtual plane perpendicular to the axis of rotation of the pressure roller, when a virtual circle is fitted to the arc shape of the guide surface, a position where the belt in circulation separates from the sliding member is on the virtual circle.

4. The fixing device of claim 2, wherein the guide member is disposed nearer to the first member than to the second member in the circumferential travel direction of the belt.

5. The fixing device of claim 1, wherein the recess is a groove parallel to the axis of rotation of the pressure roller, and the lubricant application member has an elongated shape along the groove.

6. The fixing device of claim 5, wherein the groove is at a central position of the guide surface in the circumferential travel direction of the belt.

7. The fixing device of claim 1, wherein the lubricant application member is made of an elastic material containing a lubricant and is in close contact with the inner circumferential surface of the belt due to an elastic restoring force of the lubricant application member.

8. The fixing device of claim 1, further comprising a support member that fixes and supports the first member and the guide member.

9. The fixing device of claim 1, wherein the second member is a heating roller that is heated by a heater.

10. The fixing device of claim 9, wherein positions of the pressure roller, the first member, the guide member, and the heating roller are defined relative to each other such that an axis of rotation of the heating roller is upstream in a conveyance direction of the sheet from a virtual straight line on the virtual plane perpendicular to the axis of rotation of the pressure roller, the virtual straight line connecting the axis of rotation of the pressure roller and a central portion of the fixing nip in the circumferential travel direction of the belt.

11. An image forming device including a fixing device that fixes an unfixed image on a sheet being conveyed, the fixing device comprising:

a heated endless belt;

a first member that is a non-rotating body disposed inside of the belt;

a second member disposed inside of the belt, cooperating with the first member to tension the belt;

a pressure roller disposed outside of the belt that presses against the first member via the belt, thereby forming the fixing nip between the pressure roller and the belt;

a guide member disposed inside of the belt that has a guide surface and guides the belt via the guide surface being in surface contact with an inner circumferential surface of the belt in circulation;

a sliding member disposed between the belt and the first member; and a lubricant application member that applies lubricant to the inner circumferential surface of the belt, wherein the guide member has a recess opening into the guide surface, the guide surface has an arc shape that is interrupted by the recess in a cross section taken on a virtual plane perpendicular to an axis of rotation of the pressure roller, and the lubricant application member is fitted in the recess.

* * * * *